United States Patent [19]

Kishi et al.

[11] 4,203,587

[45] May 20, 1980

[54] SHEET SORTER DEVICE

[75] Inventors: Hirotoshi Kishi, Tokyo; Hiroyuki Hattori, Inagi; Katsuichi Shimizu, Hoya, all of Japan

[73] Assignee: Canon Kabushiki Kaisha, Tokyo, Japan

[21] Appl. No.: 815,060

[22] Filed: Jul. 12, 1977

[30] Foreign Application Priority Data

| | | | |
|---|---|---|---|
| Jul. 27, 1976 | [JP] | Japan | 51-89485 |
| Dec. 25, 1976 | [JP] | Japan | 51-157188 |
| Jan. 11, 1977 | [JP] | Japan | 52-1701 |

[51] Int. Cl.[2] ..... B65H 39/10

[52] U.S. Cl. ..... 271/293; 271/176

[58] Field of Search ..... 271/173, 64, 176

[56] References Cited

U.S. PATENT DOCUMENTS

| | | | |
|---|---|---|---|
| 3,744,790 | 7/1973 | Hoffman | 271/176 X |
| 3,953,023 | 4/1976 | Cross | 271/173 |
| 3,977,667 | 8/1976 | Cross | 271/173 X |
| 3,995,748 | 12/1976 | Looney | 271/173 X |

*Primary Examiner*—Richard A. Schacher

*Attorney, Agent, or Firm*—Fitzpatrick, Cella, Harper & Scinto

[57] ABSTRACT

A sheet sorter device comprises a feeder for introducing sheets to be sorted, a conveyor for conveying the sheets from the feeder to a sheet receiving portion, a plurality of bin trays for receiving therein the sheets upwardly inclined in the direction of movement of the sheets when received, a guide for supporting and guiding the bin trays, and a bin tray displacing device capable of selectively effecting the displacement of at least one of the bin trays to a sheet receiving position by widening the entrance thereof and the holding at a predetermined position of a bin tray to be subsequently displaced.

5 Claims, 17 Drawing Figures

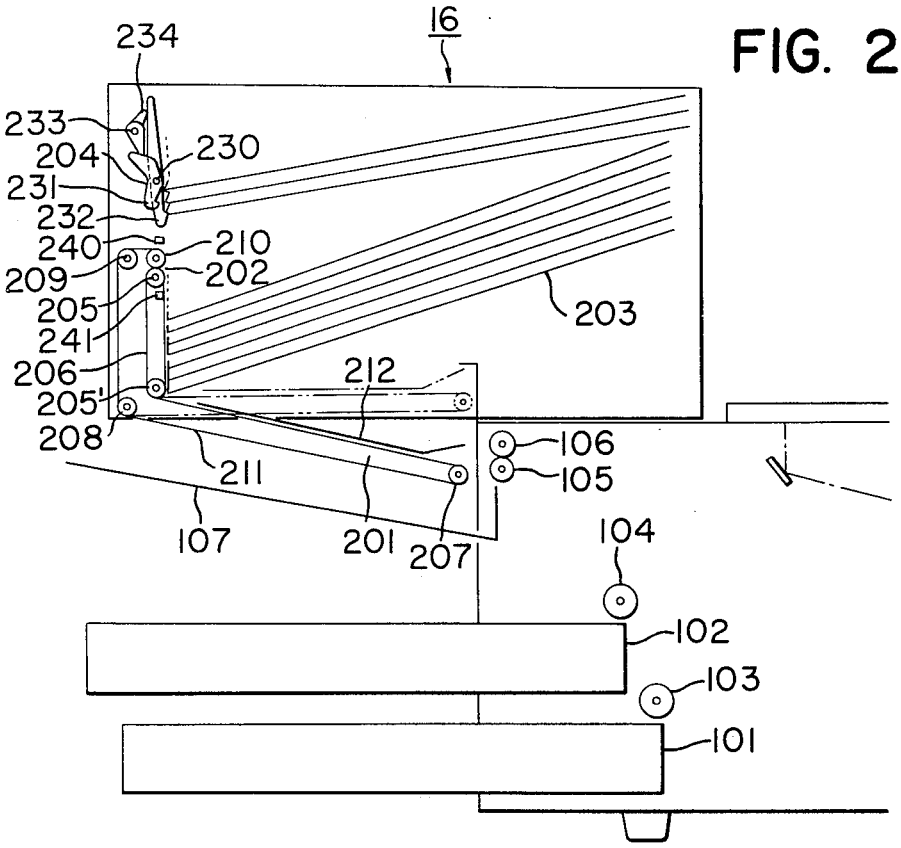
FIG. 2
FIG. 3
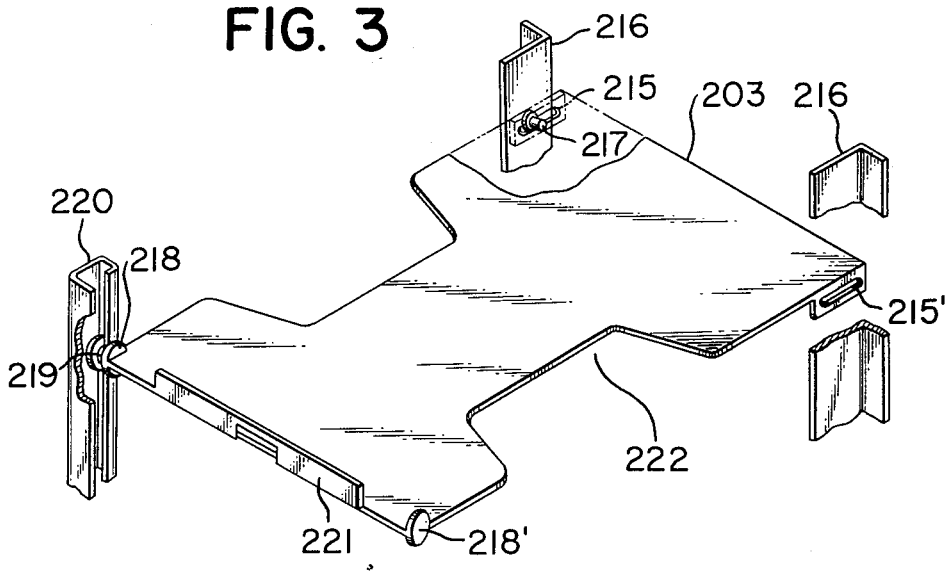

SHEET SORTER DEVICE

BACKGROUND OF THE INVENTION

1. Field of the Invention

This invention relates to a sheet sorter device for sorting sheets discharged from any of various apparatuses.

2. Description of the Prior Art

Where a plurality of sets of multi-paged documents are to be prepared in a copying or printing operation using an electrophotographic or other copying machine or a simple printer or the like, much labor and time is required in the so-called page-up which is the work of arranging the documents in order of page numbers and grouping them into individual sets of documents and moreover, such page-up is often susceptible of mistakes or errors.

When preparing a plurality of sets of multi-paged documents by the copying or printing operation, the relation between the number of the sets Mi ($i=1, \ldots, m$) and the multi-paged original Oj ($j=1, \ldots, n$) and the copies Cij may be represented as by the matrix in Table 1 below.

Table 1

| Mi | Oj | 1 | 2 | 3 | ... | n |
|---|---|---|---|---|---|---|
| 1 | | $C_{11}$ | $C_{12}$ | $C_{13}$ | ... | $C_{1n}$ |
| 2 | | $C_{21}$ | $C_{22}$ | $C_{23}$ | ... | $C_{2n}$ |
| 3 | | $C_{31}$ | $C_{32}$ | $C_{33}$ | ... | $C_{3n}$ |
| . | | . | . | . | | . |
| . | | . | . | . | | . |
| . | | . | . | . | | . |
| m | | $C_{m1}$ | $C_{m2}$ | $C_{m3}$ | ... | $C_{mn}$ |

There are two types of the copying procedure, namely, (1) the procedure which follows the columns in the above matrix and (2) the procedure which follows the rows in the above matrix. The procedure (1) which follows the columns is one which prepares copies by following the pages for each set, and this corresponds to the case that an automatic original feed device is operatively associated with a copying machine or the like. In contrast, the procedure (2) which follows the rows is one which continuously prepares a desired number of sets of one page and then a corresponding number of sets of other pages in succession and this latter procedure is generally popular. In this latter procedure, copies of the same page are piled as one set and it is therefore necessary that the copies be rearranged in order of page numbers and also be grouped and placed on distinct trays so that they may be removed separately from set to set.

To that end, there has been proposed a device which automatically distributes those copies upon copying or printing.

Some large high-speed machines have been provided with a sorter connected to the copy discharge port thereof for automatically paging up copies discharged from the discharge port.

However, such device is large-scaled and expensive and it has only been used in the places where great quantities of documents are handled (such as copy centers or the like). In the copying work carried out in common offices, page-up has been usually accomplished manually.

Also, to enhance the efficiency of the copying work using copying machines, it is necessary to rationalize the work of document rearrangement which occupies a considerable part of the copying work, such as replacement of originals, page-up of the copies produced, etc. For the automatic replacement of originals, there have already been contrived automatic original feed devices. These devices are either of the following two types: (1) the system whereby an automatic sheet original feed device is installed in a slit exposure section for the exposure of sheet originals, wherein the device is provided in addition to the original carriage for thick originals; and (2) the system whereby sheet originals are automatically fed onto the original carriage for thick originals. This latter system (2) may be adapted to be installed on the body of a copying machine with few alterations of the design of the machine. Nevertheless, in the designing of the plate on which the original to be copied is placed under pressure, some special technique is required for transporting sheet originals onto the glass surface and stopping them thereon and this is technically difficult and costly. Further, the copying speed in this system is equal to the copying speed for the ordinary thick originals and its only merit is the ease with which originals are handled. Still further, the plate on which the original to be copied is placed under pressure may often interfere with the copying operation for thick originals.

The former system (1) requires a sheet original exposure slit (optical path for exposure) to be provided in the body of the copying machine, which in turn would often involve some difficulties in the designing of the machine body, but in this system, sheet originals need only pass the exposure slit and this leads to a great ease with which the automatic original feed device of this type may be designed. Accordingly, this system is highly reliable and low in cost. Moreover, as compared with the latter system (2), it is meritorious in that the portion corresponding to the backward stroke of the optical system which effects the slit exposure is eliminated and the time corresponding thereto is saved, so that the copying speed is increased to double the copying speed of the latter system. Further, in this system, the carriage for thick original and the automatic sheet original feed device are completely independent of each other so that copying of sheet originals can cut in when copying of a thick original is taking place. However, the passage of one sheet original through the device results in production of only one copy and therefore, if a plurality of copies are desired, the same original must be repositioned as often as the number of the copies desired.

With the compact copying machines used in common offices, it is rarely the case that multiple sets of copies are required and for this reason, the former system (1) is more preferred.

SUMMARY OF THE INVENTION

It is a primary object of the present invention to construct the sheet distributing device of the described type in a compact and simple form.

It is another object of the present invention to construct bin trays upwardly inclined in the direction of movement of copy sheets and to permit the gap between two adjacent ones of the bin trays to be widened during entry of a copy sheet to thereby ensure a sufficient entrance dimension.

The upwardly inclined construction of the bin trays is excellent in distributing copy sheets of various sizes mixed with one another. That is, irrespective of the different sheet sizes, the sheets may be successively sheet original feed device 2 provided at the right end. When a start button (not shown) is depressed with an original 0 resting on the original carriage 6, the scanning mirrors are moved to their right end positions (indicated at 3' and 4', respectively) and held at these positions. At the same time, a change-over mirror is also held at its position 5' so that the image of the sheet original passed through an exposure section 7 is projected upon the drum. Subsequently, sheet originals are automatically separated and fed one by one by a separating roller 27 and further fed into between a series of feed rollers and illuminated at the exposure section 7, whereafter the sheet originals are discharged onto a tray 8. The copying machine of the present embodiment has two paper feed cassettes 12 and 13. Sheets of transfer paper selected are fed toward the photosensitive drum 11 and the image formed on the drum is transferred onto the transfer paper at an image transfer section 14. Thereafter, the sheets of transfer paper are separated from the drum and discharged onto a copy tray 9. Disposed at the left upper end of the machine body is a simple type sorter 16 so that when a conveyor belt 211 is lowered as shown, the copy sheets are further carried into the sorter 16 and then discharged onto a number of bin trays 203 through a discharge port 202. Initially, the bin trays 203 are all raised to their uppermost positions, and then they are lowered one by one in order from the bottom for each copy cycle by means of restraining levers 231, 232 and control levers 234, 235 therefor. A copy sheet is discharged into a widely open space between a lowered bin tray and a still restrained bin tray and is thus received in that lowered bin tray.

In FIG. 1, a belt pulley 207 and an auxiliary pulley 36 both disposed at one end of the belt 211 for receiving the copies discharged through a copy outlet 34 are mounted on an arm 37 which is pivotable about a shaft 39 secured to the frame 38 of the sorter. The arm 37 is formed with a slot 40 for receiving therein the pin 43 of a rotatable arm 42 secured to the output shaft of a motor 41 having a reduction gearing. This motor 41 can effect a half-rotation of the rotatable arm 42 by a signal simultaneously with each change-over between the sorting trays, thus raising the arm 37 upwardly to the position indicated by dot-and-dash line.

The auxiliary pulley 36 serves to prevent the belt 211 from having too much slack when the belt is raised upwardly. In this manner, change-over is accomplished such that copies are either conveyed into the sorter by the conveyor belt 211 or directly received onto a tray 309.

Attention is here drawn to the order and the front and back surfaces of originals and copies. In an automatic sheet original feed device, sheet originals are placed with their front surfaces facing downwardly and they are copied one by one in order from the top (the last page). Correspondingly, copies are discharged out of the machine in order from the last one with their front surfaces facing upwardly and if they are directly received onto the tray 309, the order of the copies will be in accord with the order of the originals. If the copies are discharged into the bin trays 203 in the sorter 16 (in this case, it is assumed that control is effected such that a certain series of copies are all received in one stage of bin tray), attention should be called to the fact that the copies are placed upon one another with their front surfaces facing downwardly and thus, the order of the copies becomes reverse to that of the originals.

On the other hand, where the copying is effected by the use of the original carriage, the first and subsequent pages are copied in sequence as a natural course of operation and in this case, therefore, if copies are received in the tray 309, the order of the copies will be reverse to that of the original pages copied, but if copies are received in the bin tray 203 of the sorter, the order of the copies will be in accord with that of the original pages copied.

In such a copying machine equipped with an automatic sheet original feed device, the copy tray can not intactly replace the sorter.

The sorter will now be described in particular. In FIG. 2, the sorter 16 comprises an inlet portion 201, an outlet portion 202, a group of bin trays 203 and a bin tray feed means 204. The inlet portion 201 is the means through which copy sheets discharged from the copying machine are introduced into the sorter, and the level of the inlet is adjustable in accordance with the level of the discharge port in various copying machines. Copy sheets discharged from the copying machine by conveyor means, which comprises a pair of rollers 205, 205', a belt 206, another group of rollers 207, 208, 209, 210, a belt 211 and a guide 212, are moved to the outlet portion 202 by and between the belt 211 and the guide 212 and the belt 206. The roller 208 is driven by a drive system (not shown) such as a chain and motor combination and is rotating during the operation of the copying machine.

Referring to FIGS. 3 and 4, the bin tray group 203 comprises multiple stages of bin trays slightly pivotable about and slidable on hinges 217, 217' and each of the bin trays is capable of receiving therein multiple copy sheets, the number of which is determined by the gap between adjacent ones of the bin trays, and thus a suitable number of stages of bin trays may be arranged with suitable gaps therebetween, as required.

Referring to FIGS. 7 and 8, the bin tray feed device 204 comprises pawls 231 and 232 rockable about a pivot 230, and a lever 234 rockable about a pivot 233 by solenoid or like means (not shown) to actuate the pawls, and serves to liberate the multi-stage bin trays 203 one by one for lowering. The pawls are also designed to evade the bin trays 203 when the bin trays are returned to their original positions.

Now, where n sheets of original documents are to be copied to produce m sets of copies, a first sheet original is set on the copying machine and a copy number setting device is set to m, whereafter the copying is started.

At that time, the lowermost bin tray is waiting at its receiving position. A first copy sheet enters that bin tray and when the trailing end edge of that copy sheet passes through a detecting portion 202 which comprises a lamp 240 and a light-sensing element 241, a solenoid is operated in a pulsed manner so that the pawls 231 and 232 are rocked about the pivot 230. Thereupon, the second lowermost bin tray is liberated from the pawl 232 and lowered to assume its receiving attitude, while the third and subsequent bin trays are lowered by an amount corresponding to one stage of bin tray, and then held by the pawl 232.

Thus, a second copy sheet is received into the second lowermost bin tray.

A similar sequence of operation will recur thereafter.

Thus, when the copying machine enters into the mth sheet copy cycle, there is generated a stop signal for preventing the starting of the subsequent copy cycle (i.e. the cycle for the m+1th copy sheet).

When the mth copy sheet has been received in the mth bin tray from the bottom, the bin tray group is raised upwardly by manually grasping a restoration known 242 provided on the second lowermost bin tray, until the second stage of bin tray comes to a position to be held by the pawl 232. By this operation, the bin tray group is returned to its initial arrangement.

Such restoration operation may also be automatically accomplished by actuating a suitable drive system (not shown) with the aid of the aforementioned copy cycle stop signal to thereby move a belt 244 provided with a restoration pin 243, as schematically shown in FIG. 6. That is, the restoration pin 243 is initially stationary while pushing the actuating piece 246 of microswitch 245, so that the microswitch 245 is then in operation. As the belt 244 is moved round by the copy cycle stop signal, the restoration pin 243 is separated from the actuating piece 246 so that the microswitch is deactivated, but the restoration pin 243 further continues to move upwardly and go past the lowermost bin tray and when it strikes against the second lowermost bin tray, it still continues to move upwardly while forcing up the bin tray group. When the second lowermost bin tray reaches a position to be held by the pawl 232, the restoration pin 243 effects a U-turn to move downwardly and again push the actuating piece 246 of the microswitch 245. Thus, the microswitch 245 is actuated to stop the drive system and also stop the restoration pin 243, whereby the initial condition is restored.

Now, when the first sheet original is replaced by a second one and the copying is started, copy sheets are likewise distributed one by one into the lowermost and subsequent trays in succession until the copying of the nth sheet original is completed, and thus m sets of n copy sheets are piled on the bin trays. These copies may be manually removed with ease through the cut-away 222 provided in each bin tray.

Needless to say, reducing the size of the sorter 16 requires the gap between adjacent ones of the bin trays to be reduced. Apparently, such gap depends on the number of copy sheets to be received therein, and a greater gap will be necessary for further copy sheets to be received onto the already piled copy sheets. It is therefore important in reducing the size of the sorter than the sorter should be designed such that the gap between two adjacent bin trays or the dimension of the entrance thereto is increased only when copy sheets are received therein with the gaps between the other bin trays being minimized.

In the present embodiment, as shown in FIGS. 2 to 4, the bin trays 203 upwardly inclined along the direction of movement of copy sheets are arranged in multiple stages. Each bin tray 203 has slots 215 and 215' formed in the opposite sides of the upward end thereof for receiving therein hinges 217 and 217' provided on stanchions 216 and 216', respectively, so that each bin tray is supported for pivotal movement about and sliding movement on the hinges 217 and 217'. Protrusions 218 and 218' are formed on the opposite sides of the downward end of each bin tray and the gap between adjacent bin trays is determined by the height of these protrusions. Each bin tray is further provided with a groove 219 in one side of the downward end thereof so that the bin tray is engaged with a guide stanchion 220 by means of the groove 219, thus restricting the movements of the bin tray while leaving the freedom of its vertical movement. Accordingly, each bin tray 203 can be guided along the stanchion 220, and can be pivotally and slidingly moved about on the hinges 217, 217'. Each bin tray 203 further has a riser portion 221 provided at the downward end edge thereof for preventing copy sheets from slipping down therefrom. The second lowermost bin tray is provided with a restroration thumb 242, as already noted. If desired, the lowermost bin tray may be fixedly provided, of course.

Initially, the arrangement of the bin trays is such that the lowermost bin tray lies in its copy sheet receiving position while the other bin trays are held above the copy sheet outlet portion 202 by the pawl 232. Such position is shown in FIG. 7. When a first copy sheet enters the lowermost bin tray and the trailing end edge thereof passes through the detecting portion 202 comprising the lamp 240 and the light-sensing element 241, a solenoid is operated to pivotally move the lever 234 clockwise about the pivot 233. The pawls 231 and 232 are biased by springs 237 and 238 so as to always follow the lever 234. By the lever 234, the pawl 231 and the pawl 232 are rotated counter-clockwise and clockwise, respectively, to assume their positions as shown in FIG. 8. Thus, the second lowermost bin tray is liberated from the pawl 232 for lowering, while the third and subsequent bin trays are held by the pawl 231. Since the operation of the solenoid is in a pulse-like fashion, the pawls 231 and 232 immediately return to their positions shown in FIG. 7, and the third and subsequent bin trays now come to be held by the pawl 232. This brings about a position for receiving a second copy sheet. In this manner, multiple stages of bin trays 203 are released one by one for lowering. The control of the solenoid is herein shown as being accomplished by a paper detection signal generated from a lamp and light-sensing element combination, whereas the solenoid may alternately by controlled by a suitable signal taken out from the operational sequence of the copying machine.

Once the mth copy sheet has been received in the mth bin tray from the bottom, the restoration thumb 242 provided on the second lowermost bin tray may be manually gripped to raise the bin tray group upwardly until the second lowermost bin tray comes to a position to be held by the pawl 232. When this occurs, the pawl 232 is pushed by the riser portion 222 of the bin tray 203 so that the pawl evades the riser portion against the force of the spring 236. In this manner, the bin tray group restores its initial arrangement.

Next, if the original is replaced by another one and the copying is started, an operation similar to what has been described above will be repeated.

In the present embodiment, as noted above, the lowering movement of the bin trays 203 enables copy sheets to be arranged in good order within the bin trays. Also, the arrangement of the bin tray group at a point of time whereat the distribution of copy sheets (m stes) has been completed is such that there is a large space between the lower side of the lowermost stage and the upper side of the mth stage which facilitates the removal of copies from the bin trays. Further, if the drive for the sheet introducing and conveying portion is designed so as to be controlled by the signal from the sheet detecting portion, it will also be possible, in the even of jam or like inconvenience occurring within the sheet sorter, to stop the drive to cause copy sheets discharged from the copying machine to be received by the sheet introducing portion 201 but not to be transported to the bin trays 203.

The foregoing description has been made with respect to the case that a bin tray is displaced for each copy sheet conveyed thereinto, but in some cases it is desired that after multiple copy sheets have been conveyed into a bin tray, the same bin tray be displaced, whereby multiple copy sheets may be carried into each bin tray continuously. In such cases, the operational sequence may be changed by changing over the control circuit so that each tray may be displaced once a predetermined number of copies have been produced. This would be useful when multiple sets of copies are to be produced by continuously copying multiple sheets of originals by the use of the automatic original feed device. Also, it would be rather suitable for the cases that copies of an original are sorted as one set and then bound into a book-like form through a collector, a folding machine and a J-binding machine.

Further, in the present embodiment, the bin trays may be connected to a copying machine or the like without the tray originally attached to such machine being detached therefrom. In addition, the reception of copy sheets into the sorter and the reception of copy sheets into the tray originally attached to the copying machine or the like may be selected and changed over by a very simple operation. FIG. 2 shows the case of the reception of copy sheets into the sorter 16 and this can be accomplished by upwardly raising the introducing portion 201 of the sorter 16 which is pivotable about a point near the roller 208. In FIG. 2, such raised position of the introducing portion 201 is indicated by dots-and-dash line. In this position, copy sheets are conveyed into the tray of the copying machine or the like. Thus, the reception of copy sheets into the sorter and the reception of copy sheets into the tray of the copying machine or the like may be selected simply by vertically displacing the introducing portion 201. In addition, the fact that the introducing portion 201 can be contained within the sorter 16 leads to great advantages in packing, shipping, etc.

Reference will now be had to FIGS. 9 to 12 to describe the details of the copy tray 309.

The body of the copying machine has secured thereto a support arm 323 for supporting the copy tray 309, the arm having an end formed as a bored stop portion 324 for stopping the copy tray 309. The machine body is also provided with two projections 325 for stopping the copy tray 309. The underside of the copy tray 309 is formed with a projection 326 corresponding to the stop portion 324 and receivable in the bore of the stop portion 324. The two projections 325 also serve to support the copy tray 309 in the undeside thereof. A cut-away is formed in the copy tray 309 at one end thereof adjacent to the machine body and a displacing pin 328 for displacing the copy tray 309 is received in the cut-away. The displacing pin 328 is guided along a guide groove 351. A connecting rod 329 connects the displacing pin 328 to an arm 331 secured to the output shaft of a motor 330 provided with a reduction gearing.

By a copy completion signal (the count-up signal from the copy number indicator or, in the case of using the automatic sheet original feed device, the signal representing the exhaustion of originals on the feed table 6), the motor 330 is started and the arm 331 actuates a position detecting switch 332 or 333 to thereby stop the motor.

In this manner, the trap 309 is pivotally moved about its projection 326 and between two positions.

FIGS. 9 and 12 show the tray and the condition of copy sheets piled thereon immediately after a certain sequence of copying has been completed. Since, as seen in FIG. 2, the tray is inclined so that the portion thereof adjacent to the machine body is lower, copy sheets discharged from the copying machine may slide back on the surface of the surface of the tray and strike against blocking portions $309_1$ and $309_2$ at the rear end of the tray and are thus stopped. Next, FIG. 10 shows the tray and the condition of copy sheets piled thereon immediately after the position change has been effected and another copy cycle completed. Since the tray has been pivoted, the trailing end edge of each copy sheet strikes against blocking portions $309_3$ and $309_4$ differing from those for the first sequence of copies and are thus piled on the tray. In this manner, each sequence of copies can be clearly distinguished from the other.

If the change-over device is designed such that the change-over between the two positions can be accomplished by a manually operable button (designated by 352 in FIG. 9), such function may effectively be utilized where distinct numbers of copies for respective customers are desired or where copies by abrupt order are to be distinguished. Also, if arrangement is made such that the change-over is automatically effected each time the number of copies (say, twenty sheets) as indicated by the copy counter (designated by 353 in FIG. 9) has been obtained, the trouble to count the number of the copies may conveniently be omitted where multiple copies are desired from a single original.

Figure 1:
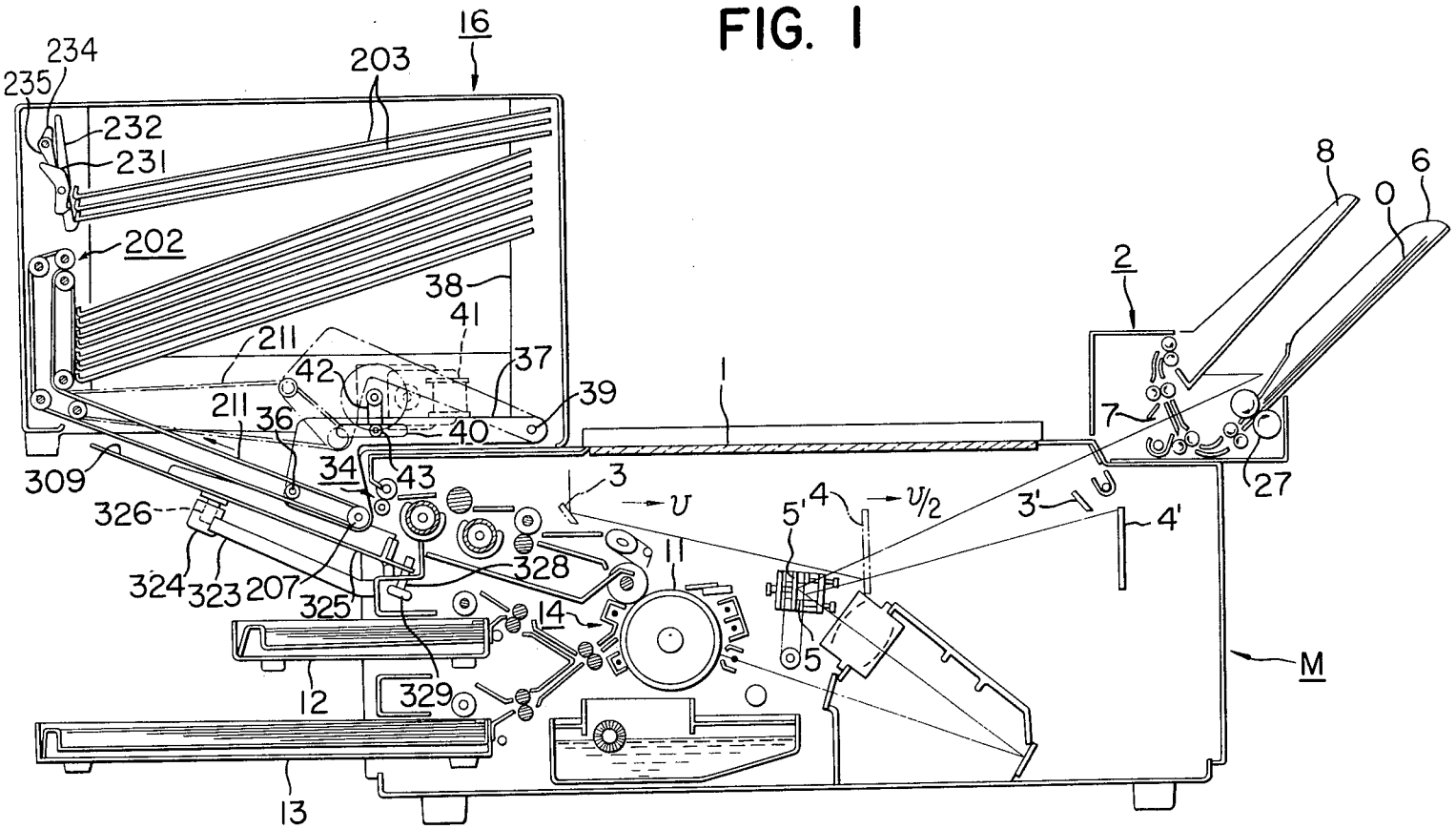
Figure 4:
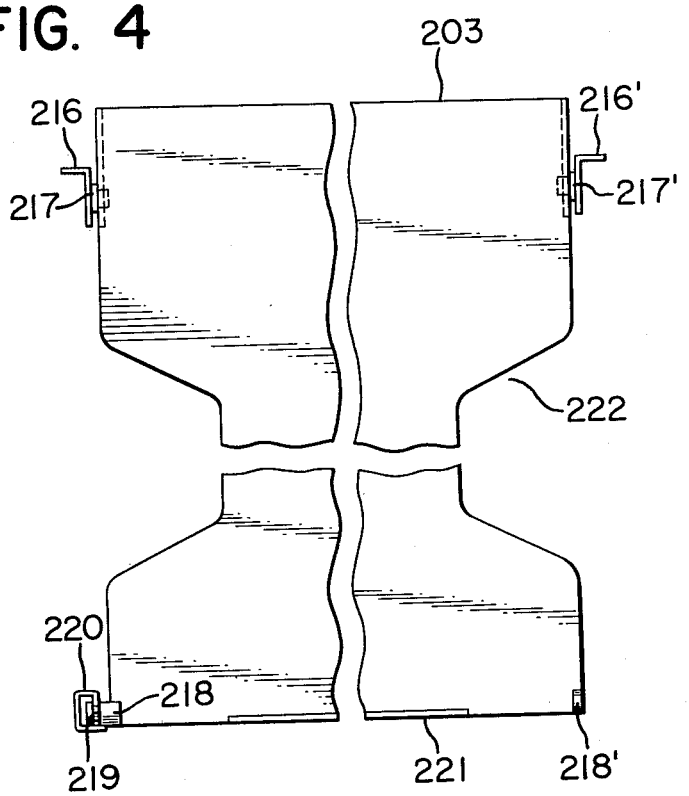
Figure 5:
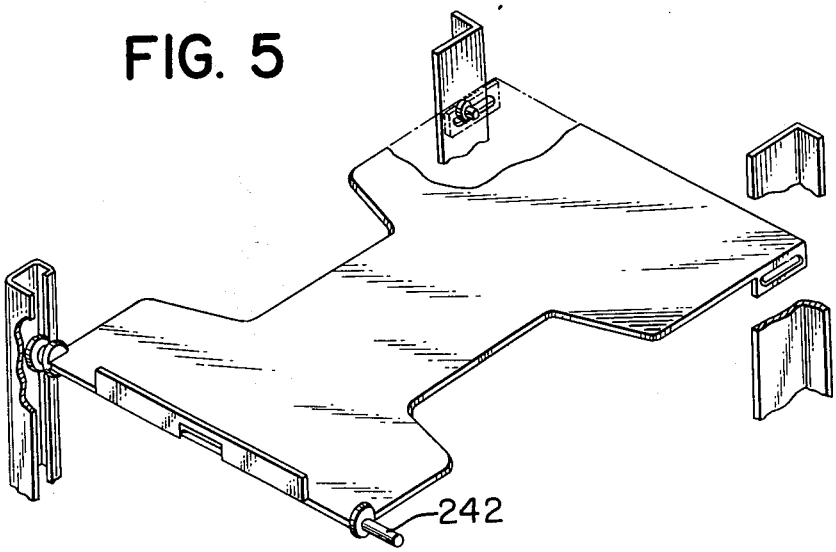
Figure 6:
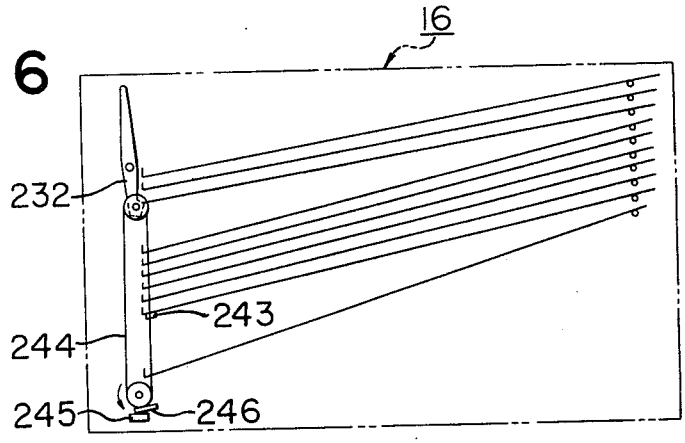
Figure 7:
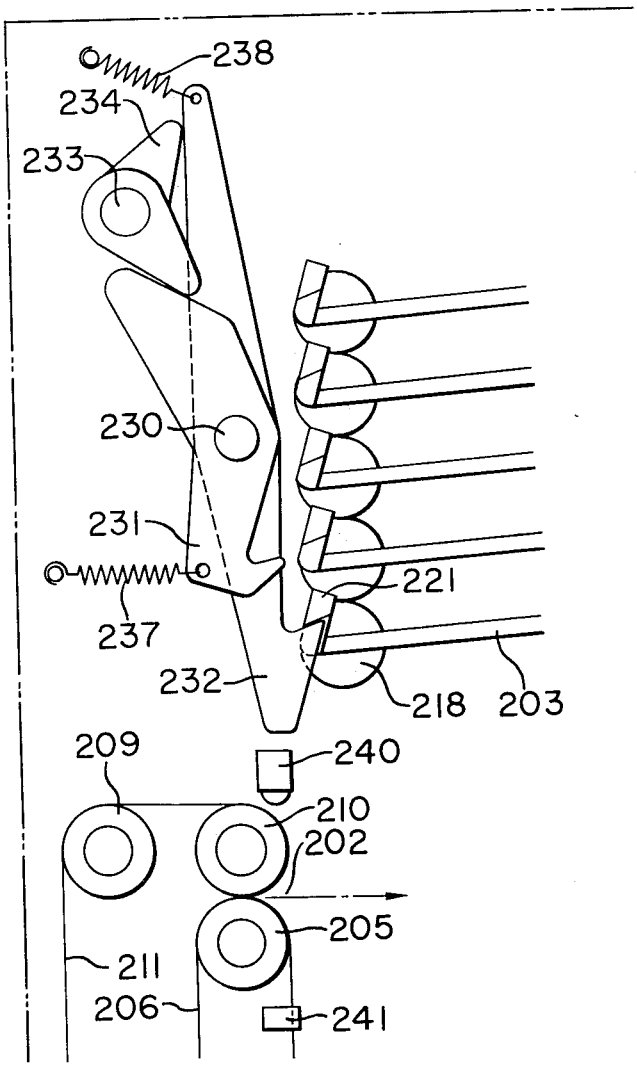
Figure 8:
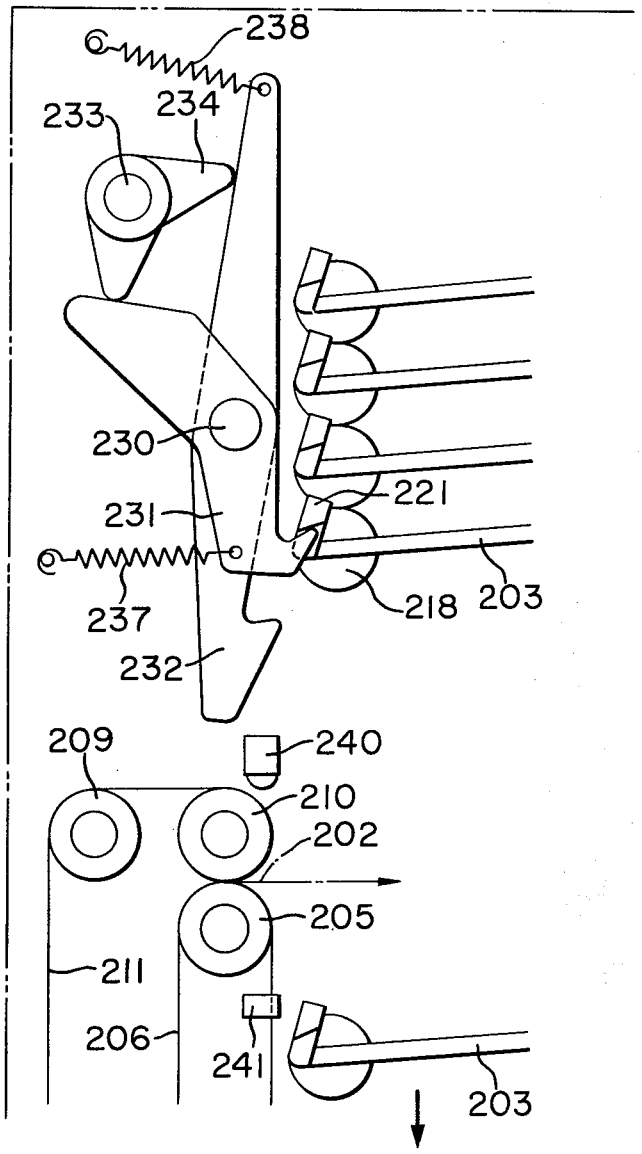
Figure 9:
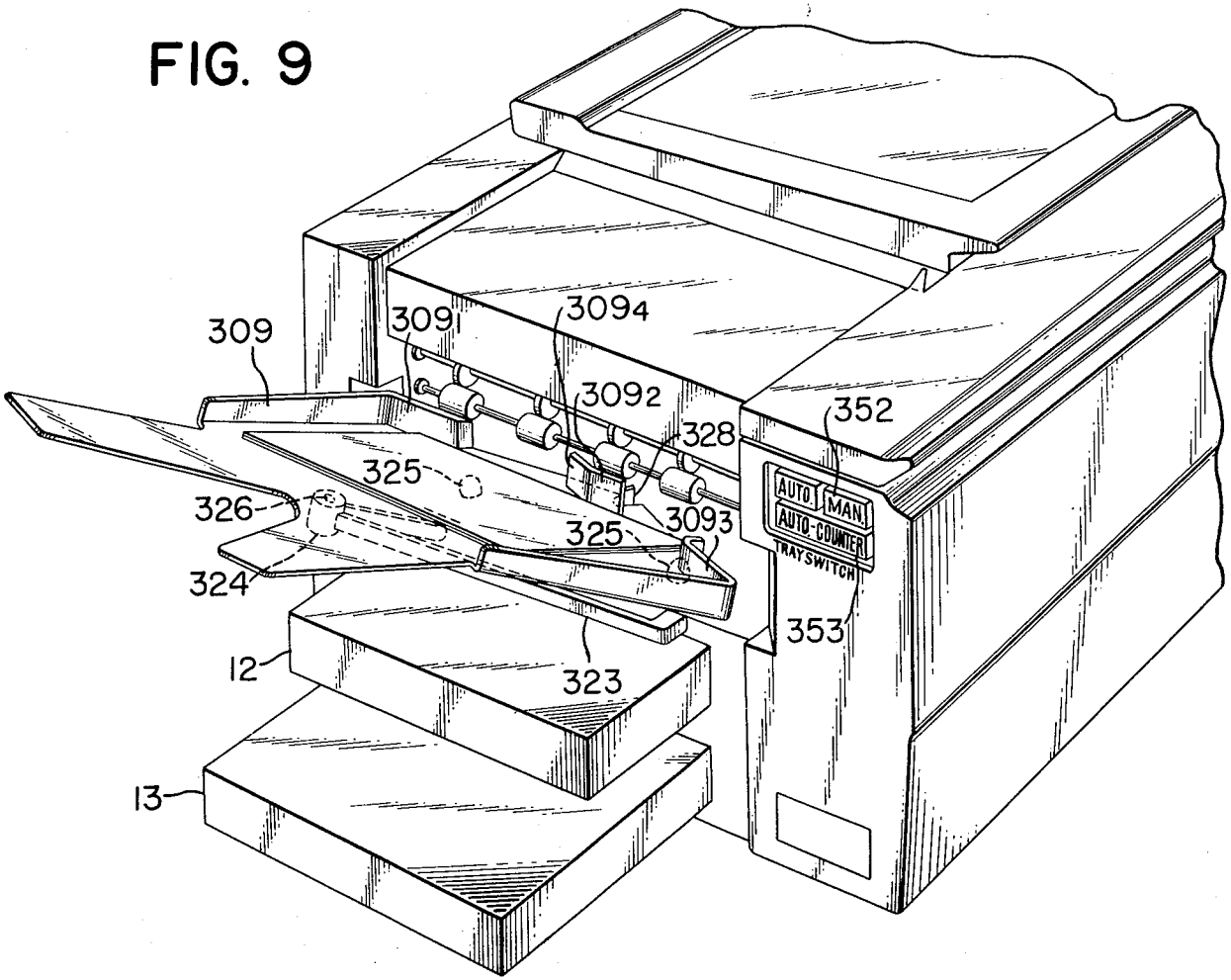
Figure 10:
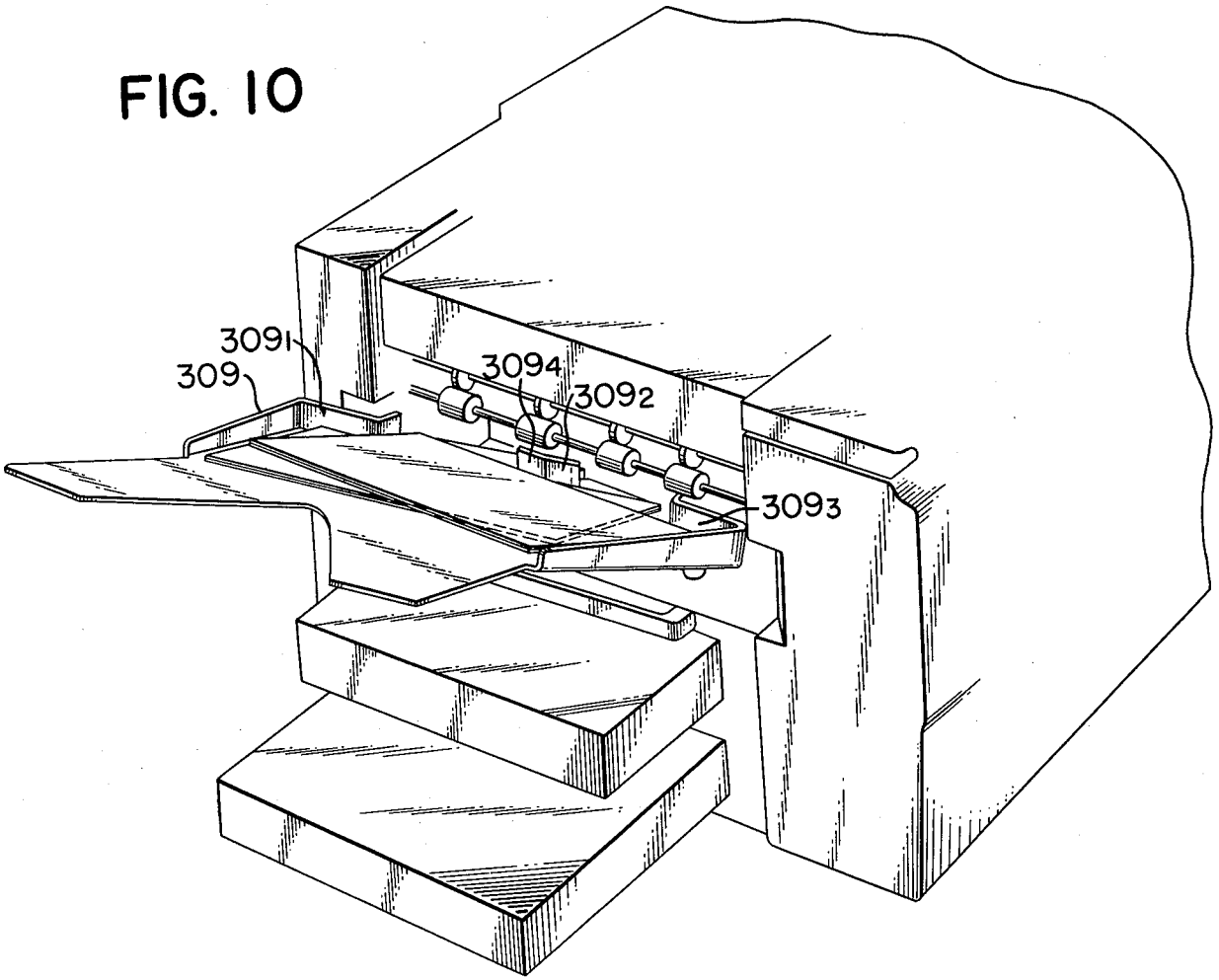
Figure 11:
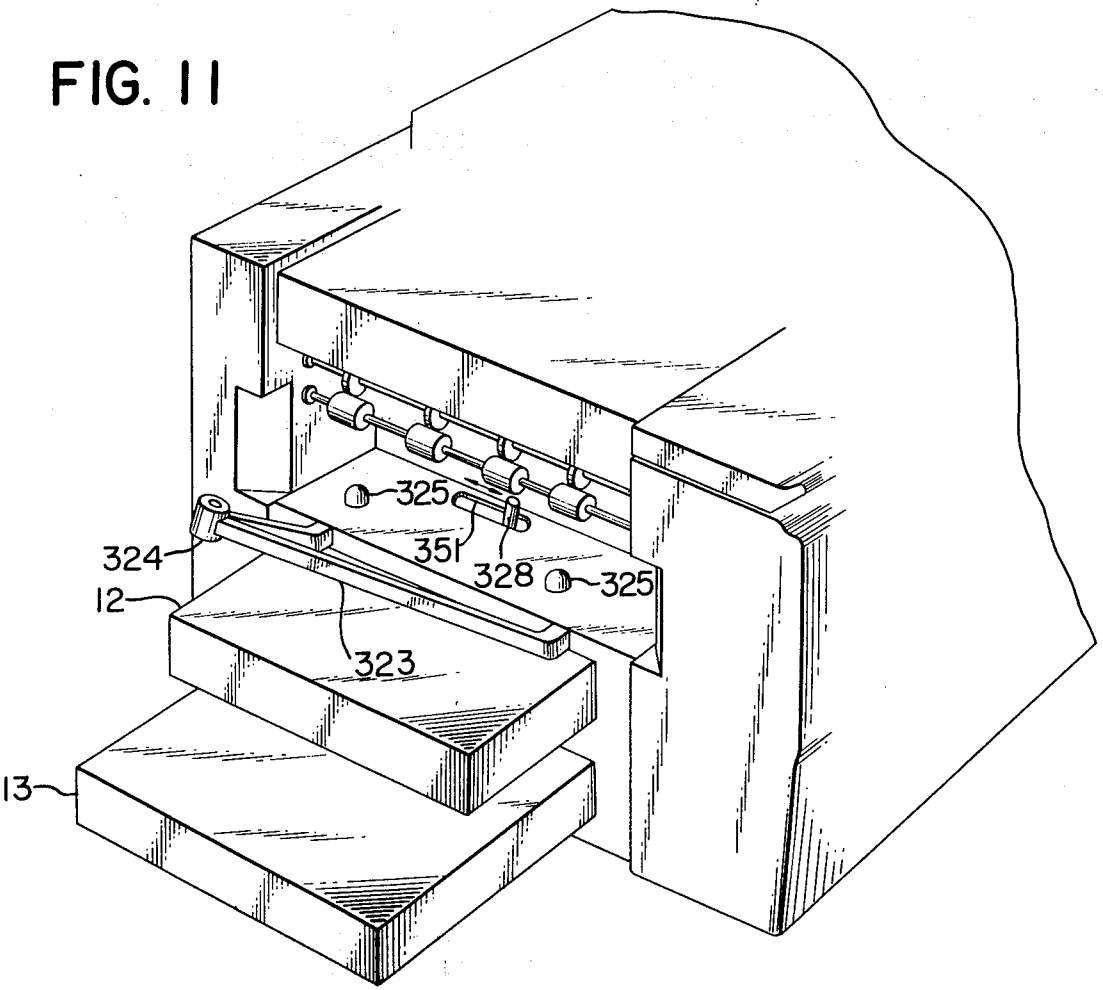
Figure 12:
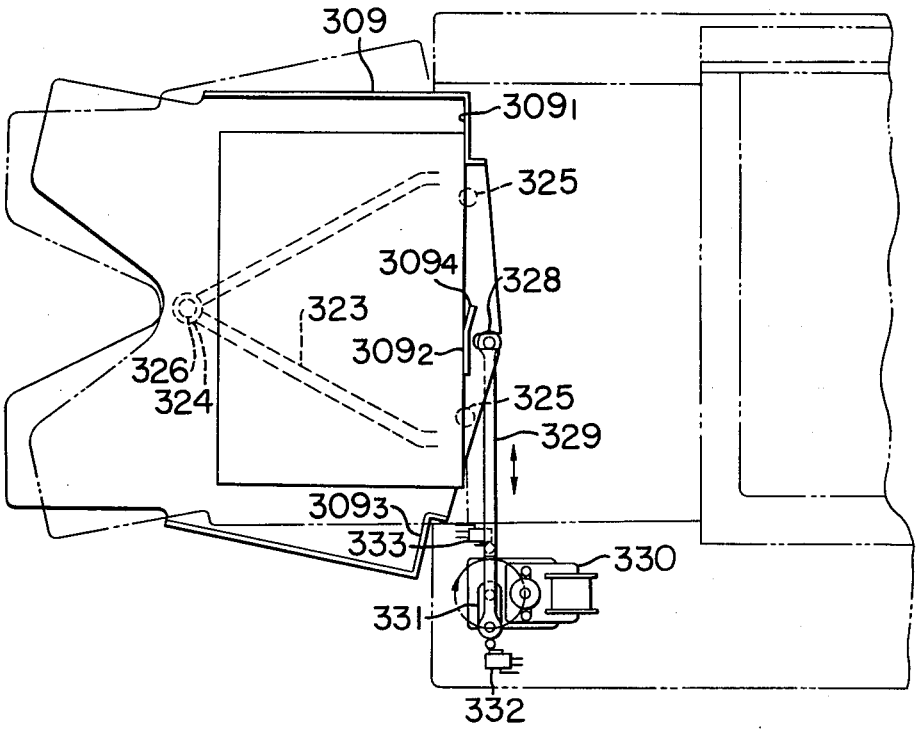
Figure 13:
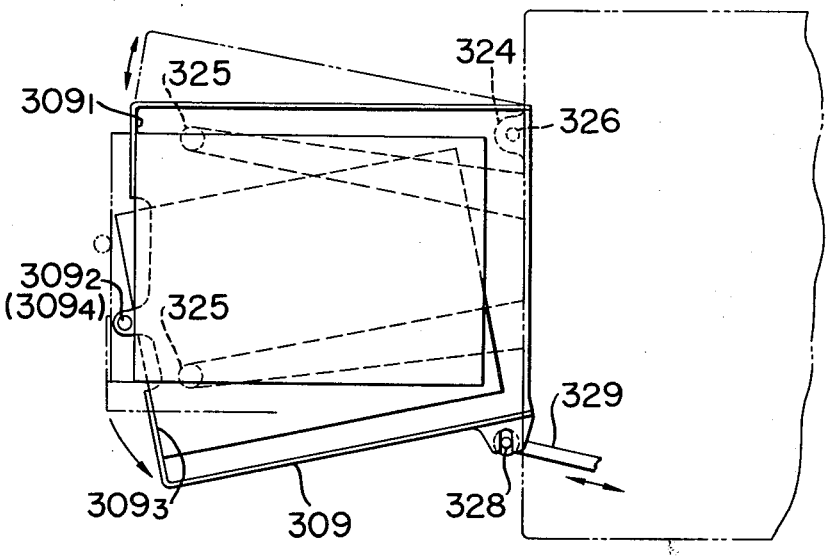
FIGS. 13 and 14 show the present invention as applied to a tray of the type which is downwardly inclined at its free end. This is identical in function to what has been described, although it differs in shape and position of various parts, and therefore corresponding reference characters are only indicated there.
Figure 14:
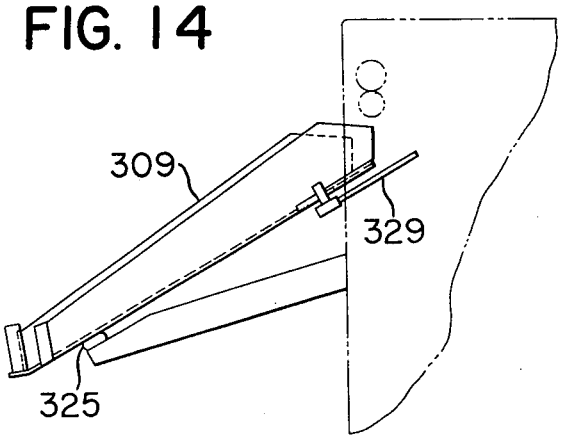
Figure 15:
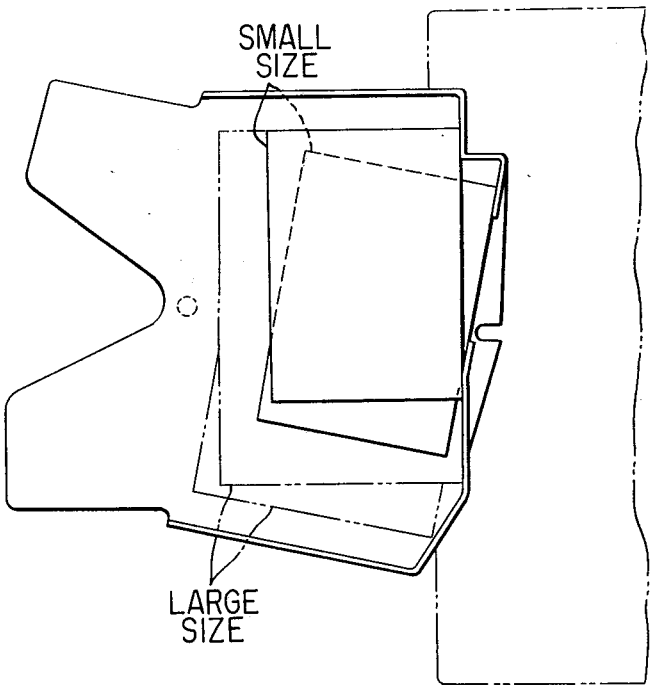
FIGS. 15 to 17 show further forms of the tray in which the shape of blocking portions is modified. With these constructions, the assorting function will work well even for copy sheets of smaller sizes.
Figure 16:
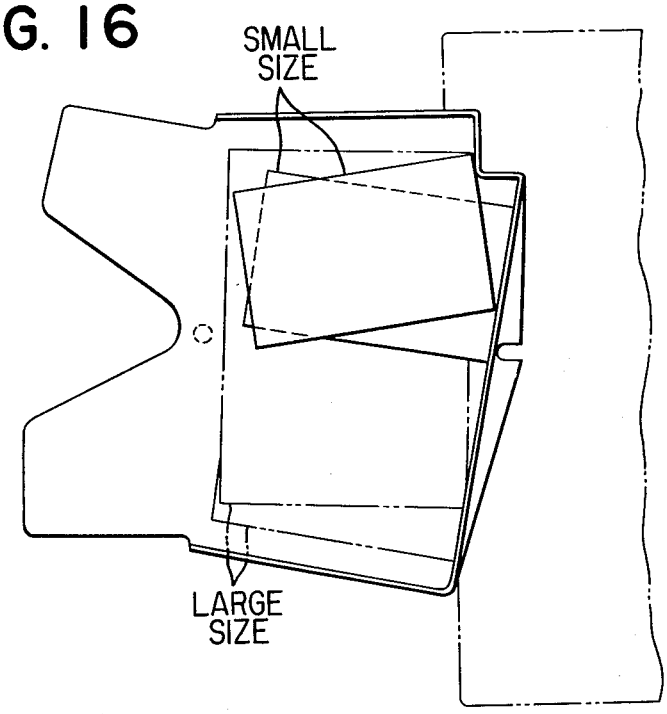
Figure 17:
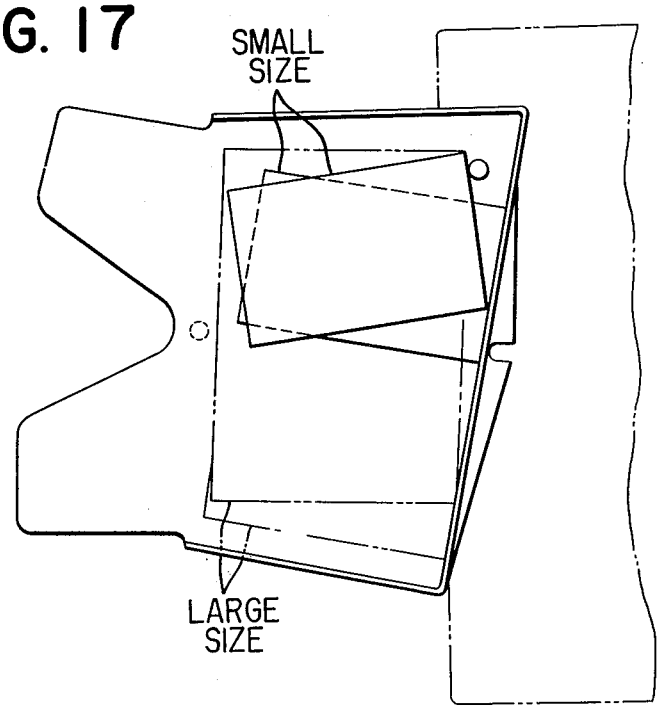

The assorting tray, even if it is single, can be made to serve as a substitute for the sorter, but if combined with the automatic sheet original feed device and the sorter, it will have a greater feature which will hereinafter be noted.

As already described, where the automatic sheet original feed device is employed, the tray may be displaced by the signal representing the exhaustion of originals on the sheet original feed table and in such a case, a required number of sets of copies are piled on the assorting tray distinctly from set to set but in the same order of pages as that of the originals, and this will facilitate the subsequent work of binding the copies by means of paper fastener or the like.

Also, in the event of overflow which readily tends to occur in sorters such as the compact sorter of the present embodiment, this assorting tray may be operatively associated therewith. In such a case, the surplus of the copies paged up in the sorter will be piled on the assorting tray distinctly from size to size. Such surplus copies will have to be manually paged up but this may be accomplished with ease because they are already assorted.

What we claim is:

1. A sheet sorter device comprising:

sheet introducing means for introducing, at a fixed position sheets to be sorted;

a plurality of bin trays for receiving sheets from said sheet introducing means, each tray having a spacer to maintain spaces between adjacent bin trays;

bin tray holding means for holding said trays stacked in a pile, wherein the lowermost said tray is initially held above said fixed sheet introducing position;

guiding means for guiding the trays downwardly in said bin tray holding means; and control means for controlling the lowermost tray to move along the guiding means under the force of gravity, to place the lowermost tray in a position for receiving a sheet, and for successively controlling the remaining trays to move downwardly under the force of gravity to form another pile of trays below said sheet introducing means, wherein said trays are successively positioned for receiving a sheet.

2. A device according to claim 1, wherein said sheet introducing means is selectively movable between a stored position within said device, and a receiving position wherein said sheet introducing means receives sheets for said introduction to the trays.

3. A device according to claim 1, wherein said control means detects a trailing end of a sheet received on each said tray, and then controls the next higher tray to move downwardly in response to said detection.

4. A sheet sorter device comprising:

sheet introducing means for introducing sheets to be sorted;

sheet conveyor means for conveying said sheets from said introducing means to a sheet receiving portion;

a plurality of bin trays disposed at said sheet receiving portion for receiving therein the sheets upwardly inclined in the direction of movement of the sheets when received;

guide means for supporting and guiding said bin trays;

bin tray displacing means for displacing at least one of said bin trays to a sheet receiving position by widening the reception entrance thereof; and an assorting copy tray displaceable to two positions and disposed for receiving copy sheets overflown from said bin trays at each of said two positions.

5. A sheet sorter device according to claim 4, wherein the copy sheets are received either in said bin trays or said assorting copy tray in accordance with the size of the copy sheets.

* * * * *